US008919873B1

(12) United States Patent
Gonzalez

(10) Patent No.: US 8,919,873 B1
(45) Date of Patent: Dec. 30, 2014

(54) APPARATUS FOR ASSISTING DIVER IN APPLICATION AND REMOVAL OF DIVING EQUIPMENT

(76) Inventor: Jorge Gonzalez, Lawrence, MA (US)

( * ) Notice: Subject to any disclaimer, the term of this patent is extended or adjusted under 35 U.S.C. 154(b) by 0 days.

(21) Appl. No.: 12/841,682

(22) Filed: Jul. 22, 2010

Related U.S. Application Data

(60) Provisional application No. 61/227,550, filed on Jul. 22, 2009.

(51) Int. Cl.
*A47B 83/02* (2006.01)
*A47B 3/14* (2006.01)

(52) U.S. Cl.
CPC ..... *A47B 3/14* (2013.01)
USPC ..... 297/163; 297/173

(58) Field of Classification Search
CPC ..... A47C 7/70; A47B 5/04; A47B 3/14
USPC ..... 108/162, 179, 115; 297/163, 135, 170, 297/173; 42/94
See application file for complete search history.

(56) References Cited

U.S. PATENT DOCUMENTS

| | | | | | |
|---|---|---|---|---|---|
| 1,979,173 | A | * | 10/1934 | Quatraro | 297/18 |
| D184,151 | S | * | 12/1958 | Schneider | D6/338 |
| 2,897,876 | A | * | 8/1959 | Austin | 297/31 |
| 3,034,827 | A | * | 5/1962 | Rassier | 297/170 |
| 3,220,765 | A | * | 11/1965 | Hoffmann | 297/124 |
| 3,387,882 | A | * | 6/1968 | Mycue | 297/163 |
| 3,420,571 | A | * | 1/1969 | Moore | 297/124 |
| 5,474,356 | A | * | 12/1995 | Johnson | 297/156 |
| 5,820,208 | A | * | 10/1998 | Miklinevich | 297/159.1 |
| 5,876,093 | A | * | 3/1999 | Williams | 297/174 R |
| 5,947,037 | A | * | 9/1999 | Hornberger et al. | 108/115 |
| 6,010,186 | A | * | 1/2000 | Tsay | 297/159.1 |
| 2003/0107246 | A1 | * | 6/2003 | Smyers | 297/170 |
| 2010/0052371 | A1 | | 3/2010 | Randall | |

* cited by examiner

*Primary Examiner* — Milton Nelson, Jr.
(74) *Attorney, Agent, or Firm* — L.C. Begin & Associates, PLLC.

(57) ABSTRACT

One embodiment of an apparatus for assisting a diver in putting on and removing diving accessories may include a seating platform. The seating platform may be adapted to be rested on a surface for enabling the diver to sit thereon. The apparatus may also include a support platform coupled with the seating platform. The support platform may be adapted to be rested on the surface for supporting the diving accessories thereon, thereby allowing the diver sitting on the seating platform to put on and remove the diving accessories.

4 Claims, 5 Drawing Sheets

APPARATUS FOR ASSISTING DIVER IN APPLICATION AND REMOVAL OF DIVING EQUIPMENT

CROSS REFERENCE TO RELATED APPLICATION

This application claims the benefit of U.S. Provisional Application No. 61/227,550 filed on Jul. 22, 2009, the disclosure of which is incorporated by reference.

FIELD OF THE INVENTION

The present disclosure generally relates to seating arrangements, and, more specifically, to an apparatus for assisting a diver to wear diving accessories.

BACKGROUND OF THE INVENTION

Scuba diving is a well known recreational and commercial activity, in which a diver is required to wear diving accessories for doing underwater diving. The diving accessories may include but not limited to an air tank, a buoyancy compensator, a mask, gloves and fins.

However, due to the heavy weight associated with certain items of diving equipment, a diver may find difficulty in handing the diving accessories. Specifically, the diver may require the assistance of another person in putting on and removing diving accessories. For example, the diver may bend down, while another person may lift the assembled diving accessories to aid the diver in applying the accessories to the diver's back. Similarly, after diving, the diver may require assistance of another person for removing the assembled diving accessories from the back of the diver. Therefore, in absence of another person's assistance, the task of donning and removing the assembled diving accessories may be cumbersome. Additionally, the task of applying and removing the assembled diving accessories may become painful for divers having some back problems.

SUMMARY OF THE INVENTION

One embodiment of an apparatus for assisting a diver in putting on and removing diving accessories may include a seating platform. The seating platform may be adapted to be rested on a surface for enabling the diver to sit thereon. The apparatus may also include a support platform coupled with the seating platform. The support platform may be adapted to be rested on the surface for supporting the diving accessories thereon, thereby allowing the diver sitting on the seating platform to put on and remove the diving accessories.

BRIEF DESCRIPTION OF THE DRAWINGS

The advantages and features of the present disclosure will become better understood with reference to the following detailed description and claims taken in conjunction with the accompanying drawings, in which:

Like reference numerals refer to like parts throughout the description of the drawings.

DETAILED DESCRIPTION OF THE INVENTION

The exemplary embodiments described herein detail for illustrative purposes are subject to many variations in structure and design. It should be emphasized, however, that the present disclosure is not limited to a particular apparatus for assisting a diver to wear diving accessories, as shown and described. It is to be understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms "a" and "an" herein do not denote a limitation of quantity, but rather denote the presence of at least one of the referenced item. The terms "first," "second," and the like, herein do not denote any order, quantity, or importance, but rather are used to distinguish one element from another. The use of terms "including," "comprising," or "having" and variations thereof herein is meant to encompass the items listed thereafter and equivalents thereof as well as additional items.

The present disclosure provides an apparatus for assisting a diver to apply diving accessories, such as an air tank. Specifically, the apparatus may assist in supporting diving accessories thereon, thereby allowing the diver to assemble the dividing accessories and don the assembled diving accessories without the need to support or fully support the accessories, and without the need for another person to help lift and support the accessories.

Figure 1:
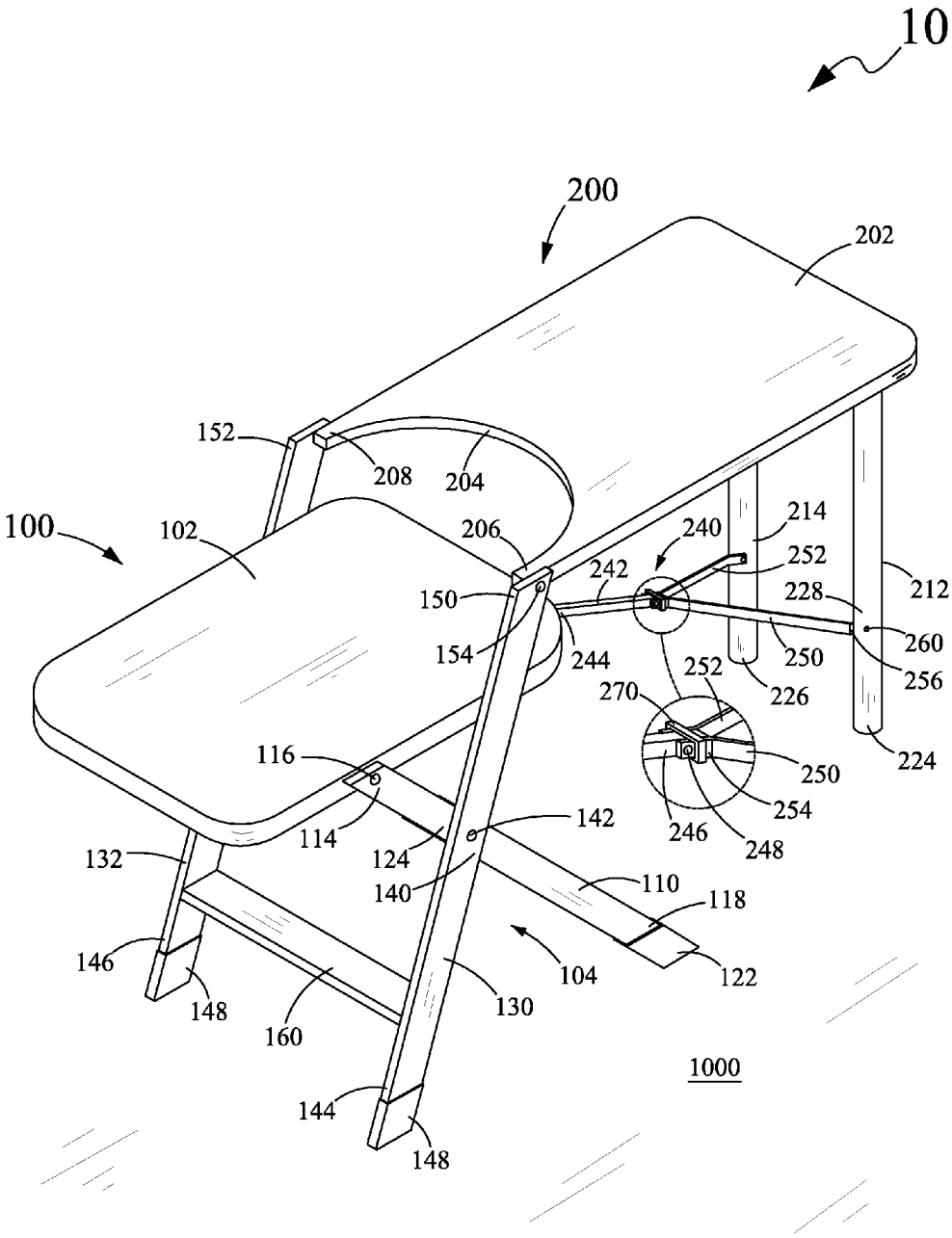
FIG. 1 is a perspective view of an embodiment of an apparatus for assisting a diver to wear diving accessories.

Referring to FIG. 1, an embodiment of an apparatus for assisting a diver to wear diving accessories (hereinafter referred to as an apparatus 10) may include a seating platform 100. The apparatus 10 may include a support platform 200 pivotally coupled with the seating platform 100, to be explained further in greater detail. The seating platform 100 may include a first plate member 102. In the present embodiment, the first plate member 102 may be a flat rectangular structure. Alternatively, the first plate member 102 may be configure to be a flat circular, a flat oval or any other flat polygonal structure.

The seating platform 100 may also include a leg assembly 104. The leg assembly 104 may include a pair of spaced apart first elongated members 110 and 112. The pair of spaced apart first elongated members 110, 112 may be pivotally coupled with the first plate member 102. For example, a top end portion 114 of the first elongated member 110 may be pivotally coupled with the first plate member 102 with the help of a suitable fastener 116, such as a nut and bolt arrangement, a screw or a rivet. Similarly, a top end portion (not shown) of the first elongated member 112 may be pivotally coupled with the first plate member 102. Therefore, the pair of spaced apart first elongated members 110, 112 may be adapted to pivotally move with respect to the first plate member 102 about the top end portions thereof. Further, bottom end portions 118 and 120 of the pair of spaced apart first elongated members 110, 112, respectively, may be adapted to rest the first plate member 102 on a surface 1000, such as floor or ground. Each of the bottom end portions 118, 120 may a gripping member 122, which may aid in providing better traction between the pair of spaced apart first elongated members 110, 112 and the surface 1000.

The leg assembly 104 may also include a pair of spaced apart second elongated members 130 and 132. The pair of spaced apart second elongated members 130, 132 may be pivotally coupled with the corresponding pair of spaced apart first elongated members 110, 112. For example, an intermediate portion 140 of the second elongated member 130 may be pivotally coupled with an intermediate portion 124 of the first elongated member 110 with the help of a suitable fastener 142, such as a nut and bolt arrangement, a screw or a rivet. Similarly, an intermediate portion (not shown) of the second elongated member 132 may be pivotally coupled with an intermediate portion (not shown) of the first elongated member 112. Therefore, the pair of spaced apart first elongated members 110, 112 and the pair of spaced apart second elongated members 130, 132 may be adapted to pivotally move with respect to each other about the intermediate portions thereof.

Further, bottom end portions 144 and 146 of the pair of spaced apart second elongated members 130, 132, respectively, may be adapted to be rested on the surface 1000. The each of the bottom end portions 144, 146 may carry a gripping member 148, which may aid in providing better traction between the pair of spaced apart second elongated members 130, 132 and the surface 1000. Moreover, top end portions 150 and 152 of the pair of spaced apart second elongated members 130, 132, respectively, may be pivotally coupled with the support platform 200, as will be explained further in greater detail.

The leg assembly 104 may also include at least one first transverse member, such as a first transverse member 162, extending between the pair of spaced apart first elongated members 110, 112. The first transverse member 162 may be rigidly coupled to the pair of spaced apart first elongated members 110, 112 for maintaining a fixed distance therebetween. The, the leg assembly 104 may also include at least one second transverse member, such as a second transverse member 160, extending between the pair of spaced apart second elongated members 130, 132. The second transverse member 160 may be rigidly coupled to the pair of spaced apart second elongated members 130, 132 for maintaining a fixed distance therebetween. It is to be understood that number of transverse members extending between the pair of spaced apart first elongated members 110, 112, and between the pair of spaced apart second elongated members 130, 132, should not be considered as limitation to the present disclosure.

The support platform 200 may include a second plate member 202. In the present embodiment, the second plate member 202 may be a flat rectangular structure having a cutout portion 204. The cutout portion 204 may be a semicircle in shape and may define a pair of protruding edges 206, 208 of the second plate member 202. As explained herein, the second plate member 202 may be pivotally coupled with the seating platform 100. Specifically, the top end portions 150, 152 of the pair of spaced apart second elongated members 130, 132 may be pivotally coupled with pair of protruding edges 206, 208, respectively, of the second plate member 202. For example, the top end portions 150, 152 may be the pivotally coupled with pair of protruding edges 206, 208 with a suitable fastener 154, such as a nut and bolt arrangement, a screw or a rivet. Therefore, the second plate member 202 may be adapted to pivotally move with respect to the pair of spaced apart second elongated members 130, 132.

In a particular embodiment, a non-slip or friction-enhancing material is applied to an upper surface of second plate member 202 to aid in preventing slippage or sliding of a piece of equipment or other object placed or supported on the surface.

The support platform 200 may also include at least one leg member, such as leg members 212 and 214. The leg members 212, 214 may be pivotally coupled with the second plate member 202. Specifically, top end portions (not shown) of the leg members 212, 214 may be pivotally coupled with a bottom surface (not shown) of the second plate member 202 with a suitable fastening mechanism (not shown), such as a mounting bracket and a nut and bolt arrangement. The leg members 212, 214 may be adapted to rest the second plate member 202 on the surface 1000. Specifically, bottom end portions 224 and 226 of the leg members 212, 214, respectively, may be adapted to rest the second plate member 202 on the surface 1000.

Figure 3:
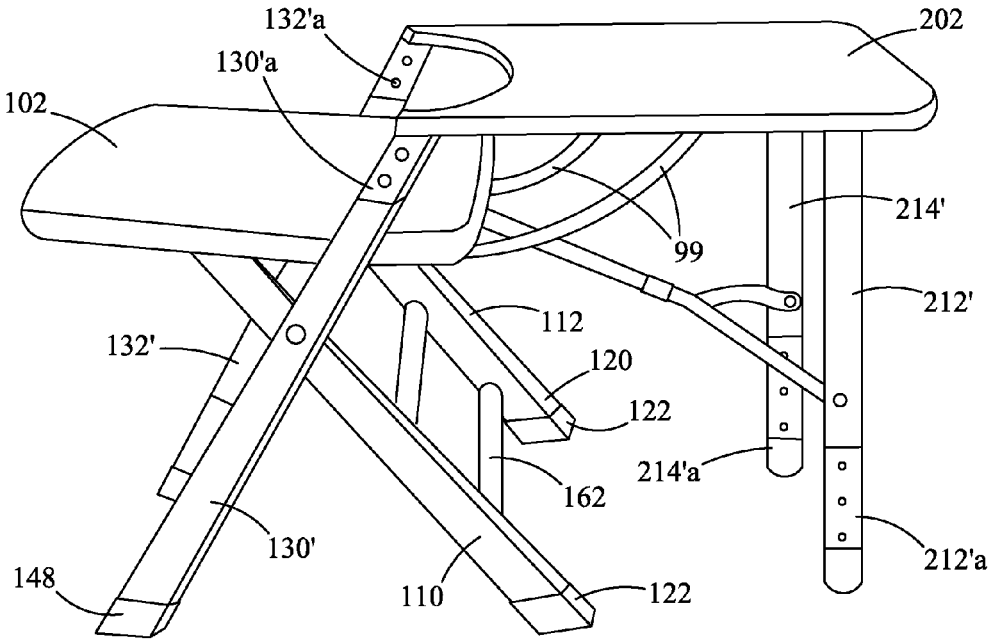
FIG. 3 is a side view of an apparatus in accordance with an alternative embodiment of the present invention.

Referring to FIG. 3, in an alternative embodiment, upper portions 130'*a* and 132'*a* of elongated members 130' and 132' are configured so as to telescope or as to be otherwise adjustable, and lower portions 212'*a* and 214'*a* of leg members 212' and 214' are configured so as to telescope or so as to have lengths that are otherwise adjustable. This enables the height above ground of second plate member 202 to be adjusted. This enables a user to adjust the height of the surface on which the equipment is rested, according to the requirements of a particular user and/or piece of equipment. The upper portions of the elongated members and the leg members can be adjusted to a desired length and secured at this length using any suitable mechanism, for example spring pins, set screws, or clamping mechanisms.

The support platform 200 may also include a connector assembly 240. The connector assembly 240 may be adapted to couple the leg members 212, 214 with the first plate member 102. The connector assembly 240 may be adapted to retain the first plate member 102 member in a fixed position when the leg members 212, 214 are rested on the surface 1000, to be explained further in greater detail below. In the present embodiment, the connector assembly 240 may include a first connecting link 242. The first connecting link 242 may be a rectangular tubing pivotally coupled with the first plate member 102. Specifically, a first end portion 244 of the first connecting link 242 may be pivotally coupled with a bottom surface (not shown) of the first plate member 102 using a suitable fastening mechanism (not shown), such as a mounting bracket and a nut and bolt arrangement.

The connector assembly 240 may also include a pair of second connecting links 250 and 252. The pair of second connecting links 250, 252 may be pivotally coupled with the first connecting link 242 and also with the leg members 212, 214. Specifically, a second end portion 246 (shown in enlarged view), opposite to the first end portion 244, of the first connecting link 242 may pivotally coupled with the pair of second connecting links 250, 252. Specifically, each link of the pair of second connecting links 250, 252 may include curved end portions pivotally coupled with the first connecting link 242, and the pair of second connecting links 250, 252. For example, a first curved end portion 254 of the second connecting link 250 may be pivotally coupled with the second end portion 246 of the first connecting link 242 with a suitable fastener 248 (shown in enlarged view), such as a nut and bolt arrangement, a screw or a rivet. Further, a second curved end portion 256, opposite to the first curved end portion 254, of the second connecting link 250 may be pivotally coupled with an intermediate portion 228 of the leg member 212 using a suitable fastener 260, such as a nut and bolt arrangement, a screw or a rivet. Similarly, the second connecting link 252 may be pivotally coupled with the first connecting link 242 and the leg member 212 as just described.

The connector assembly 240 may also include a locking member 270 (shown in enlarged view), adapted to be carried by the first connecting link 242. In the present embodiment, the locking member 270 may be one of a rectangular or a circular loop-like structure carried by the first connecting link 242. The locking member 270 may be adapted to be slidably moved along the first connecting link 242. Further, the locking member 270 may be adapted to encircle the second end portion 246 of the first connecting link 242, and also the first curved end portions, such as the first curved end portion 254, of the pair of second connecting links 250, 252. Therefore, the locking member 270 is movable to a locking position to prevent a pivotal movement between the second end portion 246 of the first connecting link 242 and the first curved end portions of the pair of second connecting links 250, 252. By preventing pivotal movement between the first connecting link 242 and the pair of second connecting links 250, 252, this locking feature retains the first plate member 102 in the fixed position, when the leg members 212, 214 are rested on the surface 1000. Additionally, when the locking member 270 is removed or repositioned (unlocked) from the second end portion 246 and the first curved end portions (such as first curved end portion 254), the first connecting link 242 and the pair of second connecting links 250, 252 are allowed to move pivotally.

Figure 2:
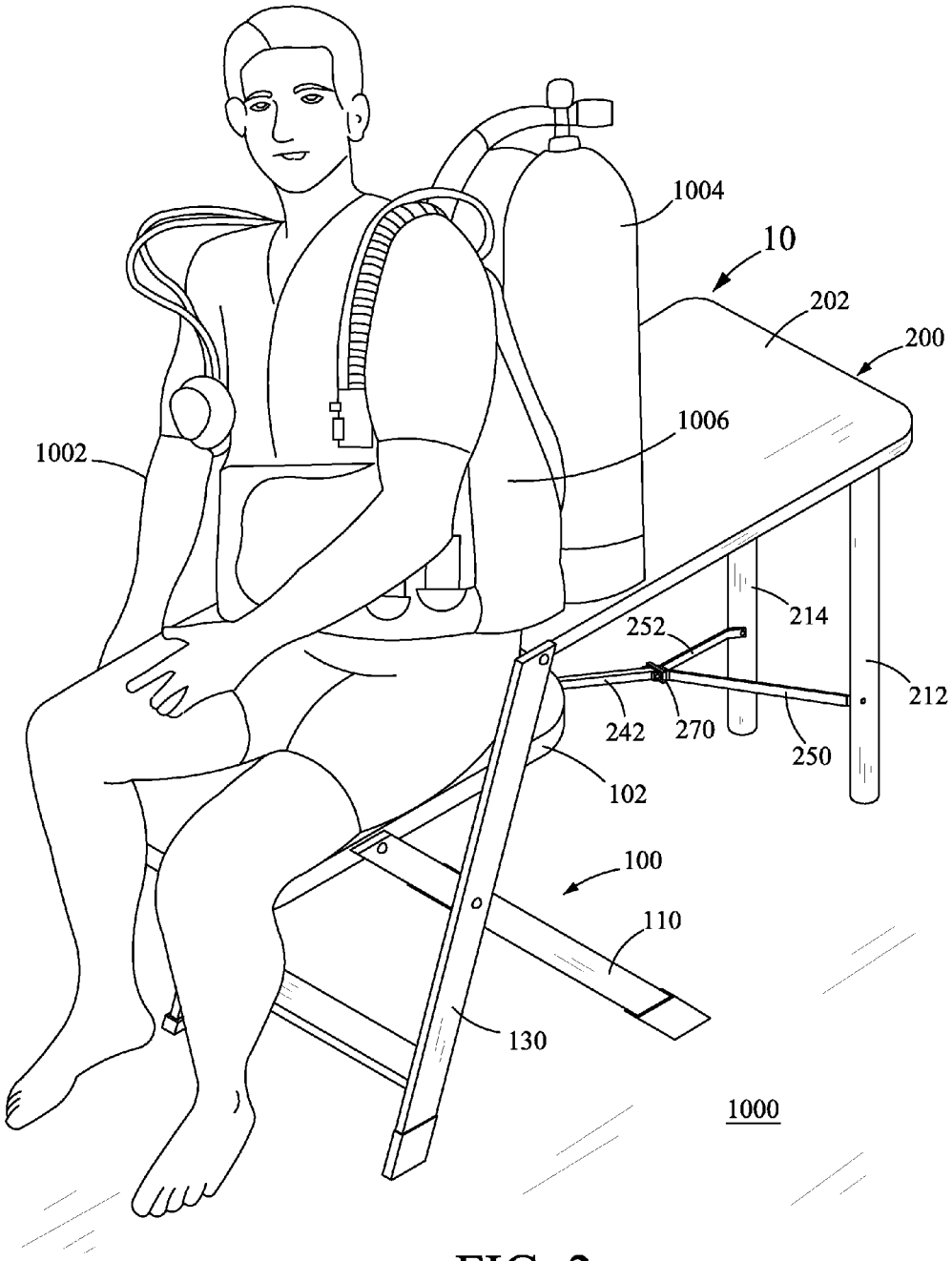
FIG. 2 is an environment in which the apparatus of FIG. 1 may be utilized by a diver for wearing the diving accessories.

Referring now to FIG. 2, in use, initially the apparatus 10 may be set on the surface 1000. Specifically, the leg assembly 104 of the seating platform 100 may be allowed to rest on the surface 1000 for supporting the first plate member 102 on the surface 1000. For example, the bottom end portions 118, 120 of the pair of spaced apart first elongated members 110, 112; and the bottom end portions 144, 146 of the pair of spaced apart second elongated members 130, 132 may be allowed to rest on the surface 1000 for supporting the first plate member 102 on the surface 1000. It is to be understood that, the pair of spaced apart first elongated members 110, 112, and the pair of spaced apart second elongated members 130, 132 may be pivotally adjusted in manner such that the first plate member 102 may be oriented substantially parallel to the surface 1000.

Further, the leg members 212, 214 of the support platform 200 may be pivotally moved for resting the second plate member 202 on the surface 1000. Specifically, the bottom end portion 224, 226 of the leg member 212, 214 may be rested on the surface 1000 for positioning the second plate member 202 parallel to the surface 1000. Further, the locking member 270 of the connector assembly 240 may be locked to prevent pivotal movement between the first connecting link 242 and the pair of second connecting links 250, 252 (as explained above), for retaining the first plate member 102 in the fixed position, thereby setting the apparatus 10 on the surface 1000 for use.

Once the apparatus 10 is set on the surface 1000, the apparatus 10 may be utilized by a diver 1002 for putting on diving accessories. Specifically, the diver 1002 may place the diving accessories, such as an air tank 1004 and a buoyancy compensator 1006, on the second plate member 202 of the support platform 200. Thereafter the diver 1002 may conveniently assemble the air tank 1004 and the buoyancy compensator 1006. Further, the diver 1002 may sit on the first plate member 102 of the seating platform 100. This allows the diver 1002 conveniently don the assembled diving accessories, such as the air tank 1004 and the buoyancy compensator 1006, while sitting on the seating platform 100. The diver 1002 may also apply the diving accessories, such as a mask, gloves and fins (not shown), while sitting on the apparatus 10. Therefore, the apparatus 10 may enable the diver 1002 to conveniently prepare himself for diving.

Further, after completion of diving, the diver 1002 may use the apparatus 10 for removing the diving accessories from his body. Specifically, the diver 1002 may sit on the seating platform 100 for allowing the assembled diving accessories, such as the air tank 1004 and the buoyancy compensator 1006, to be rested on the support platform 200. This allows the diver 1002 to conveniently remove the assembled diving accessories from his back while sitting on the seating platform 100. Further, the diver 1002 may also remove the diving accessories, such as the mask, the gloves and the fins, while sitting on the seating platform 100. Therefore, the apparatus 10 may also enable the diver 1002 to conveniently remove the diving accessories from his body after diving.

Figure 4:
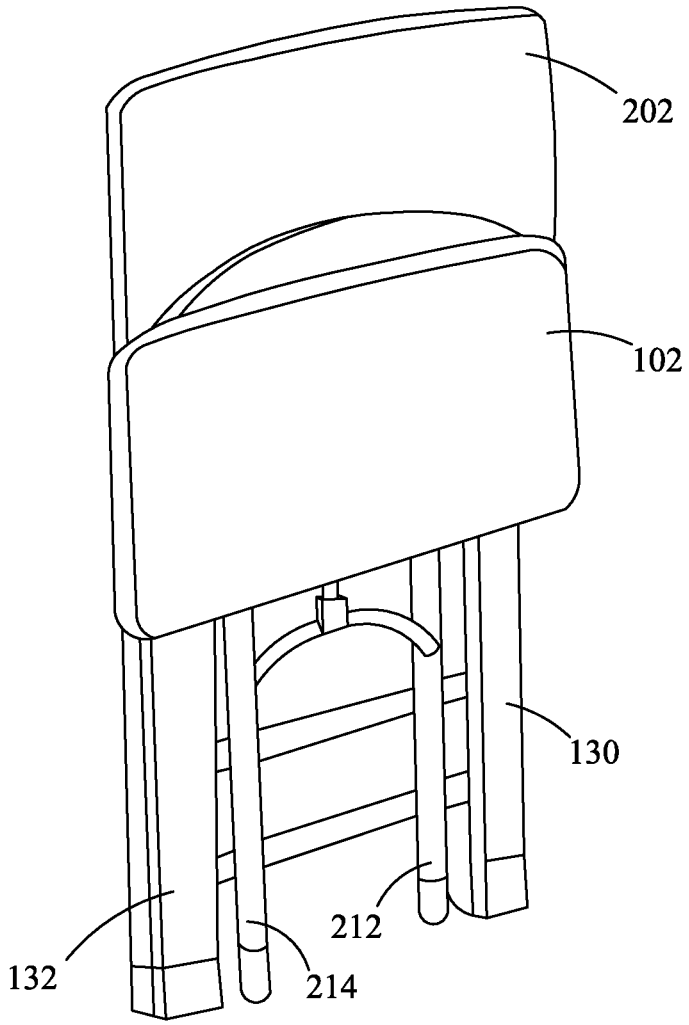
FIGS. 4 and 5 are views showing the embodiment of FIG. 1 in a folded configuration.

Moreover, after the use of the apparatus 10, the apparatus 10 may be folded for being conveniently transported from one place to another place or for the storage thereof. For allowing the apparatus 10 to attain a folded state (shown in FIGS. 4 and 5), initially the locking member 270 may be positioned to unlock the first connecting link 242 and the pair of second connecting links 250, 252. This allows the first connecting link 242 to move pivotally and parallel to the second plate member 202. Thereafter, the leg members 212, 214 may be pivotally moved towards the second plate member 202 for allowing the leg members 212, 214 and the pair of second connecting links 250, 252 to be oriented parallel to the second plate member 202. Further, the pair of spaced apart first elongated members 110, 112 may be pivotally moved towards the second plate member 202 for being oriented parallel to the first plate member 102. Thereafter, the pair of spaced apart second elongated members 130, 132 may be pivotally moved away from the second plate member 202 for being oriented parallel to the first plate member 102, thereby allowing the apparatus 10 to attain the folded state.

Figure 5:
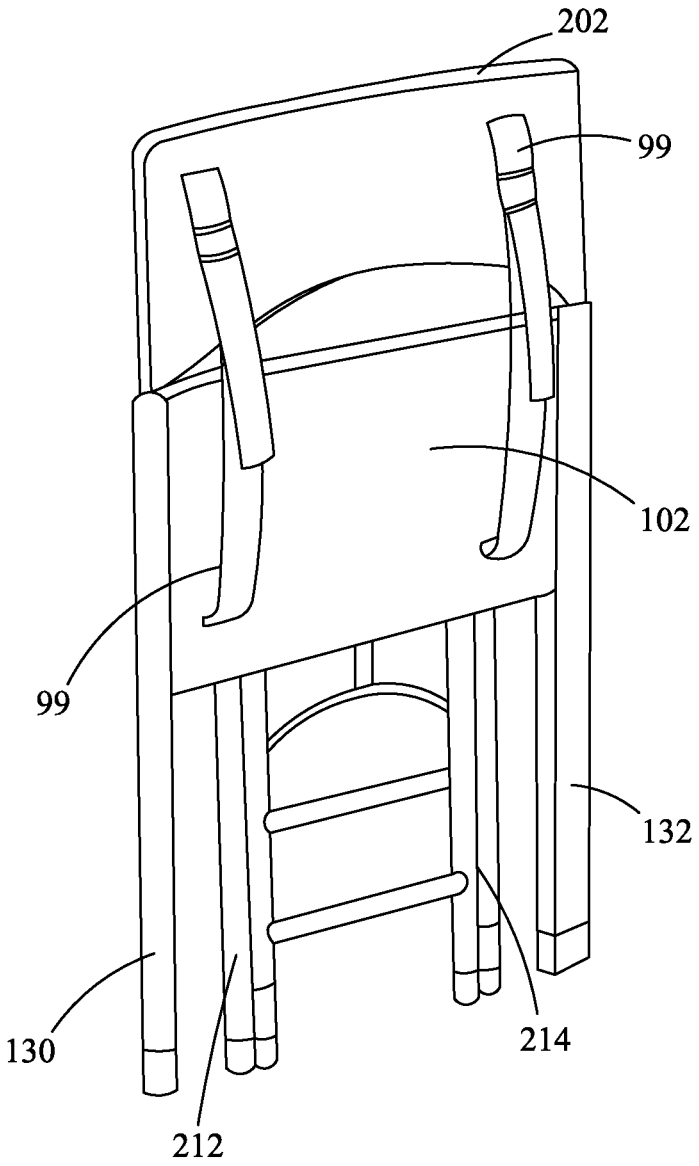

In the particular embodiment shown in FIG. 5, end portions of adjustable carrying straps 99 are suitably coupled to first plate member 102 and second plate member 202 to aid in transportation of the apparatus when in a folded configuration. For example, straps 99 may be adjusted so as to fit over the shoulders of a user.

The apparatus 10 of the present disclosure may be made of a material having sufficient structural rigidity such that the apparatus 10 may be capable of bearing the load of the diver 1002 and the diving accessories, such as an air tank 1004, and a buoyancy compensator 1006. Further, the apparatus 10 may be made of a lightweight and non-corrosive material. A suitable example of the lightweight and non-corrosive material may include but not limited to aluminum, plywood and thermoplastic. For example, the components, such as the first plate member 102 and the second plate member 202, of the apparatus 10 may be made of either plywood or thermoplastic. Furthermore, the components, such as the leg assembly 104, the leg members 212, 214, and the connector assembly 240, of the apparatus 10 may be made of aluminum. It is to be understood that the material of the apparatus 10 should not be considered as limitation to the present disclosure.

Based on the forgoing description, an apparatus, such as the apparatus 10 may provide a simple and efficient tool that assists a diver in wearing and removing diving accessories from his/her body. The apparatus may avoid a need of another person's assistance while wearing and removing the diving accessories. The apparatus of the present disclosure may be light-weighted and adapted to be folded for being conveniently transported from one place to another place. Further, the apparatus may be adapted to be conveniently stored in a small space in a folded state thereof.

The foregoing descriptions of specific embodiments of the present disclosure have been presented for purposes of illustration and description. They are not intended to be exhaustive or to limit the disclosure to the precise forms disclosed, and obviously many modifications and variations are possible in light of the above teaching. The embodiments were chosen and described in order to best explain the principles of the disclosure and its practical application, and thereby enable others skilled in the art to best utilize the disclosure and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present disclosure.

What is claimed is:

1. An apparatus for assisting a diver to put on and remove diving accessories, the apparatus comprising:

a seating platform adapted to be rested on a surface for enabling the diver to sit thereon wherein the seating platform comprises— a first plate member, and a leg assembly pivotally coupled with the first plate member, the leg assembly adapted to support the first plate member on the surface wherein the leg assembly comprises— a pair of spaced apart first elongated members pivotally coupled with the first plate member, and a pair of spaced apart second elongated members pivotally coupled with the corresponding pair of spaced apart first elongated members; and a support platform coupled with the seating platform, the support platform adapted to be rested on the surface for supporting the diving accessories thereon, thereby allowing a diver sitting on the seating platform to put on and remove the diving accessories, wherein the support platform comprises— a second plate member pivotally coupled with the pair of spaced apart second elongated members, at least one leg member pivotally coupled with the second plate member, the at least one leg member adapted to support the second plate member on the surface, and a connector assembly coupling the at least one leg member with the first plate member, the connector assembly adapted to retain the first plate member in a fixed position when the at least one leg member rests on the surface.

2. The apparatus of claim 1, wherein the connector assembly comprises:

a first connecting link pivotally coupled with the first plate member, at least one second connecting link pivotally coupled with the first connecting link and the at least one leg member, and a locking member adapted to prevent a pivotal movement between the first connecting link and the pair of second connecting links when the locking member is engaged, thereby retaining the first plate member in the fixed position.

3. An apparatus comprising:

a seating platform adapted to be rested on a surface for enabling a user to sit thereon wherein the seating platform comprises— a first plate member, and a leg assembly pivotally coupled with the first plate member, the leg assembly adapted to support the first plate member on the surface wherein the leg assembly comprises— a pair of spaced apart first elongated members pivotally coupled with the first plate member, and a pair of spaced apart second elongated members pivotally coupled with the corresponding pair of spaced apart first elongated members; and a support platform coupled with the seating platform, the support platform adapted to be rested on the surface for supporting accessories thereon, thereby allowing one sitting on the seating platform to use the accessories, wherein the support platform comprises— a second plate member pivotally coupled with the pair of spaced apart second elongated members, at least one leg member pivotally coupled with the second plate member, the at least one leg member adapted to support the second plate member on the surface, and a connector assembly coupling the at least one leg member with the first plate member, the connector assembly adapted. to retain the first plate member in a fixed position when the at least one leg member rests on the surface.

4. The apparatus of claim 3, wherein the connector assembly comprises:

a first connecting link pivotally: coupled with the first plate member, at least one second connecting link pivotally coupled with the first connecting link and the at least one leg member, and a locking member adapted to prevent a pivotal movement between the first connecting link and the pair of second connecting links when the locking member is engaged, thereby retaining the first plate member in the fixed position.

* * * * *

UNITED STATES PATENT AND TRADEMARK OFFICE

CERTIFICATE OF CORRECTION

PATENT NO. : 8,919,873 B1
APPLICATION NO. : 12/841682
DATED : December 30, 2014
INVENTOR(S) : Gonzalez It is certified that error appears in the above-identified patent and that said Letters Patent is hereby corrected as shown below:

In the Specification

Column 2; Line 64; insert --carry-- after may.

Column 3; Line 35; delete ",".

Column 3; Line 35; delete the second occurrence of "the".

In the Claims

Column 8; Line 34; Claim 3; delete the "." after adapted.

Column 8; Line 39; Claim 4; delete the ":" after pivotally.

Signed and Sealed this
Third Day of March, 2015

Michelle K. Lee

Michelle K. Lee
*Deputy Director of the United States Patent and Trademark Office*